US006006800A

United States Patent [19]

Nakano

[11] Patent Number: 6,006,800

[45] Date of Patent: Dec. 28, 1999

[54] APPARATUS AND METHOD FOR AUTOMATIC DISTRIBUTION

[75] Inventor: Susumu Nakano, Tokyo, Japan

[73] Assignee: Nichiryo Co., Ltd., Tokyo, Japan

[21] Appl. No.: 08/975,994

[22] Filed: Nov. 21, 1997

[51] Int. Cl.[6] ..... B65B 43/42

[52] U.S. Cl. ..... 141/130; 141/9; 73/864.13; 73/864.24; 73/864.25; 422/100

[58] Field of Search ..... 141/1, 9, 98, 100, 141/130; 73/864.24, 864.25, 864.31, 864.13; 422/63, 65, 100; 436/47

[56] References Cited

U.S. PATENT DOCUMENTS

| | | | |
|---|---|---|---|
| 4,160,699 | 7/1979 | Sogi et al. | 435/287 |
| 4,938,080 | 7/1990 | Sarrine et al. | 73/864.21 |
| 5,306,510 | 4/1994 | Meltzer | 73/864.25 |
| 5,639,425 | 6/1997 | Komiyama | 73/864.25 |

*Primary Examiner*—Henry J. Recla
*Assistant Examiner*—Timothy L. Maust
*Attorney, Agent, or Firm*—Wenderoth, Lind & Ponack, L.L.P.

[57] ABSTRACT

An apparatus for automatic distribution includes a frame (1) having at least a bottom frame portion (1*a*) and a side frame portion (1*b*), a tip holding rack (2) and at least one micro plate (4, 5) which are disposed on the bottom frame (1*a*). A pipette unit (21) is supported by the side frame portion (1*b*) and adapted to support a plurality of pipettes (43), each of which includes a plunger (41) fitted into a cylinder (35) for movement relative thereto in a vertical direction. In this apparatus the bottom frame portion (1*a*) is kept stationary and the entire pipette unit (21) can be reciprocally moved in a horizontal direction so that, while the entire pipette unit (21) is being moved reciprocally in the horizontal direction, the pipette unit picks up a plurality of tips (44) from the tip holding rack (2) in order to distribute liquid with respect to a plurality of wells (4*a*–4*h*) of the micro plate.

6 Claims, 7 Drawing Sheets

APPARATUS AND METHOD FOR AUTOMATIC DISTRIBUTION

BACKGROUND OF THE INVENTION

1. Field of the Invention

The present invention relates to an apparatus and method for automatic distribution, in which an arrangement around a table can be simplified and the apparatus can easily be handled by reciprocally moving in a horizontal direction an entire pipette unit holding a plurality of pipette cylinders.

2. Related Background Art

Among apparatuses for automatic distribution, there has been proposed an apparatus and method for automatic distribution of multi-pipette type in which a tip holding rack and a sample plate (or micro plate) are disposed on a table and a pipette unit holding a plurality of pipettes (referred to as "multi-pipette" appropriately hereinafter) is provided, for example, as disclosed in Japanese Utility Model Registration No. 3002709. In such an apparatus, the table is reciprocally moved in a horizontal direction to move the pipettes relatively between a position of the tip holding rack and another position of the sample plate, thereby distributing reagent and the like.

However, according to the above-mentioned apparatus, since the entire length of the apparatus corresponds to a total length obtained by adding a movement length (distance) of the table to a length of the table itself, the entire length of the apparatus becomes great, thereby making the apparatus larger.

SUMMARY OF THE INVENTION

A first object of the present invention is to provide an apparatus for automatic distribution which can be made more compact by permitting reciprocal movement of an entire pipette unit in a horizontal direction.

A second object of the present invention is to provide an apparatus for automatic distribution in which strength is increased and an operation of the apparatus can easily be observed by providing a frame having an L-shaped cross-section.

A third object of the present invention is to provide an apparatus for automatic distribution in which positional accuracy and operability can be improved by permitting engagement between a dovetail groove of an entire pipette unit and a straight guide member (rail) and by pinching another straight guide member between a pair of rotatable rollers.

A fourth object of the present invention is to provide an apparatus for automatic distribution in which the positioning can be performed cheaply with a high degree of accuracy by moving an entire pipette unit in a horizontal direction.

A fifth object of the present invention is to provide a method for automatic distribution in which reagent from a reservoir can be distributed automatically and efficiently into wells which are arranged on at least one micro plate in plural rows and in plural columns.

A sixth object of the present invention is to provide a method for automatic distribution in which undesired dropping of liquid droplets from tips can be prevented and liquid can effectively be discharged from the tips by establishing a post-suction air gap stroke and a pre-suction air gap stroke.

A seventh object of the present invention is to provide a method for automatic distribution in which applications can be widened by using a PCR tube or a micro plate in place of a reservoir.

To achieve the above objects, according to the present invention, there is provided an apparatus for automatic distribution comprising a frame (1) having at least a bottom frame **(1*a*) and a side frame (1*b*), a tip holding rack (2) and at least one micro plate (4, 5) which are disposed on the bottom frame (1*a*), and an entire pipette unit (21) supported by the side frame (1*b*) and adapted to support a plurality of pipettes (43) each including a plunger (41) fitted into a cylinder (35) for movement relative thereto in a vertical direction. The bottom frame (1*a*) is stationary and the entire pipette unit (21) can be reciprocally moved in a horizontal direction. The entire pipette unit picks up a plurality of tips (44) from the tip holding rack (2) to distribute liquid into a plurality of wells (4*a*–4*h*) of the sample plate (4, 5)**.

With this arrangement, unlike the above related art in which a table is reciprocally moved, since the entire pipette unit is reciprocally moved within a length of the bottom frame or table, the entire length of the apparatus can be decreased, thereby making the apparatus more compact.

The frame (1) may have a substantially L-shaped cross-section defined by the bottom frame **(1*a*) and the side frame (1*b*) provided at one side of the bottom frame. Also at least one pair of posts (7*a*, 7*b*) may protrude from the other side of the bottom frame and one straight guide member (8*b*) may be supported by the side frame (1*b*) and the other straight guide member (8*a*) may be supported by the pair of posts (7*a*, 7*b*), so that the entire pipette unit (21) is reciprocally moved in the horizontal direction while being guided by the two straight guide members (8*a*, 8*b*)**. With this arrangement, since the frame has the L-shaped cross-section, rigidity of the apparatus is increased, and an operation of the apparatus can easily be observed to facilitate maintenance by observing the apparatus from a side opposite to the side frame after a cover is removed from the apparatus.

The entire pipette unit (21) may further include a pair of rollers (15) for always pinching the one straight guide member **(8*a*), and a dovetail groove (16) always engaged with the other straight guide member (8*b*)**. With this arrangement, a vertical position of the entire pipette unit can be determined with a high degree of accuracy by the engagement between the dovetail groove and the straight guide member and slide friction resistance of the entire pipette unit can be reduced due to rolling friction of the rollers by pinching the straight guide member by means of the pair of rollers, thereby improving positional accuracy and operability.

The frame (1) may include an endless timing belt (13) extending in a direction along which the entire pipette unit (21) is reciprocated and a drive means (11) for driving the timing belt (13), and a predetermined portion of the timing belt (13) may be secured to the entire pipette unit (21) so that the entire pipette unit (21) can be reciprocally moved by a driving force of the drive means (11). With this arrangement, the timing belt mechanism can be simplified and the entire pipette unit can be positioned with a high degree of accuracy.

The present invention further provides a method for automatic distribution performed by using an apparatus for automatic distribution comprising a frame (1) having at least a bottom frame **(1*a*) and a side frame (1*b*), a tip holding rack (2), a reservoir (3), at least one first micro plate (4, 5), and a used-tip disposing box (6) which are disposed on the bottom frame (1*a*), and an entire pipette unit (21) supported by the side frame (1*b*) and adapted to support a plurality of pipettes (43) each including a plunger (41) fitted into a cylinder (35) for movement relative thereto in a vertical direction. The method comprises a first step for attaching tips (44) to lower ends of the plurality of pipettes (43) by moving the plurality of pipettes (43) in downward and upward directions, a second step for bringing the entire pipette unit (21) to a position corresponding to the reservoir (3) by moving the entire pipette unit in the horizontal direction by a first predetermined distance and then for sucking predetermined liquid into the tips (44) by moving the plurality of pipettes (43) in the downward and upward directions, a third step for bringing the entire pipette unit (21) to a position corresponding to a first row of wells (4***a*) of the micro plate (4) by further moving the entire pipette unit in the horizontal direction by a second predetermined distance and then for distributing the liquid with respect to the first row of wells (4*a*) by moving the plurality of pipettes (43) in the downward and upward directions, a fourth step for distributing the liquid with respect to the other rows of wells (4*b*–4*h*) of the first micro plate (4) by further moving the entire pipette unit successively in the horizontal direction by a third predetermined distance, and a fifth step for bringing the entire pipette unit (21) to a position corresponding to the used-tip disposing box (6) by further moving the entire pipette unit in the horizontal direction by a fourth predetermined distance and for disposing the tips (44) into the used-tip disposing box (6) and then for returning the entire pipette unit (21) to an initial position. With this arrangement, reagent from the reservoir can be distributed automatically and efficiently with respect to the wells arranged on at least one micro plate in plural rows and in plural columns.

A stroke through which the plunger (41) is moved with respect to the cylinder (35) in the vertical direction to suck and discharge the liquid may include a post-suction air gap stroke through which the plunger is further moved in the upward direction by a predetermined distance to prevent the liquid from dropping from the tips after the liquid is sucked into the tips (44), a metering stroke for sucking a predetermined amount of liquid into each tip (44) and for discharging the liquid from the tip (44), and a pre-suction air gap stroke through which the plunger is further moved in the upward direction by a predetermined distance to completely remove the liquid from the tip during the liquid discharging in the post-process before the liquid is sucked into the tip. With this arrangement, since there is the post-suction air gap stroke after the liquid is sucked into the tips, while the tips are being moved to the next position in the horizontal direction, the liquid can be prevented from dropping from the tips. Also, since there is the pre-suction air gap stroke, the liquid can be removed from the tips completely during the liquid discharging in the post-process.

In the second step, while the plurality of pipettes (43) are being moved in the downward direction, the plungers (41) may be lowered within the corresponding cylinders (35) to continue to discharge the air from tip ends of the tips steadily so that the fact that the tip ends of the tips come in contact with the liquid surface can be detected, thereby automatically detecting the position of the liquid surface. With this arrangement, since the position of the liquid surface can automatically be detected with a high degree of accuracy, the correct liquid distribution can be achieved.

Applications can be widened by using a PCR tube containing the test liquid in place of the reservoir (3).

Applications can be further widened by using a second micro plate in place of the reservoir (3) and by distributing the test liquid in the second micro plate into the first micro plate (4, 5).

DETAILED DESCRIPTION OF PREFERRED EMBODIMENTS

Figure 1:
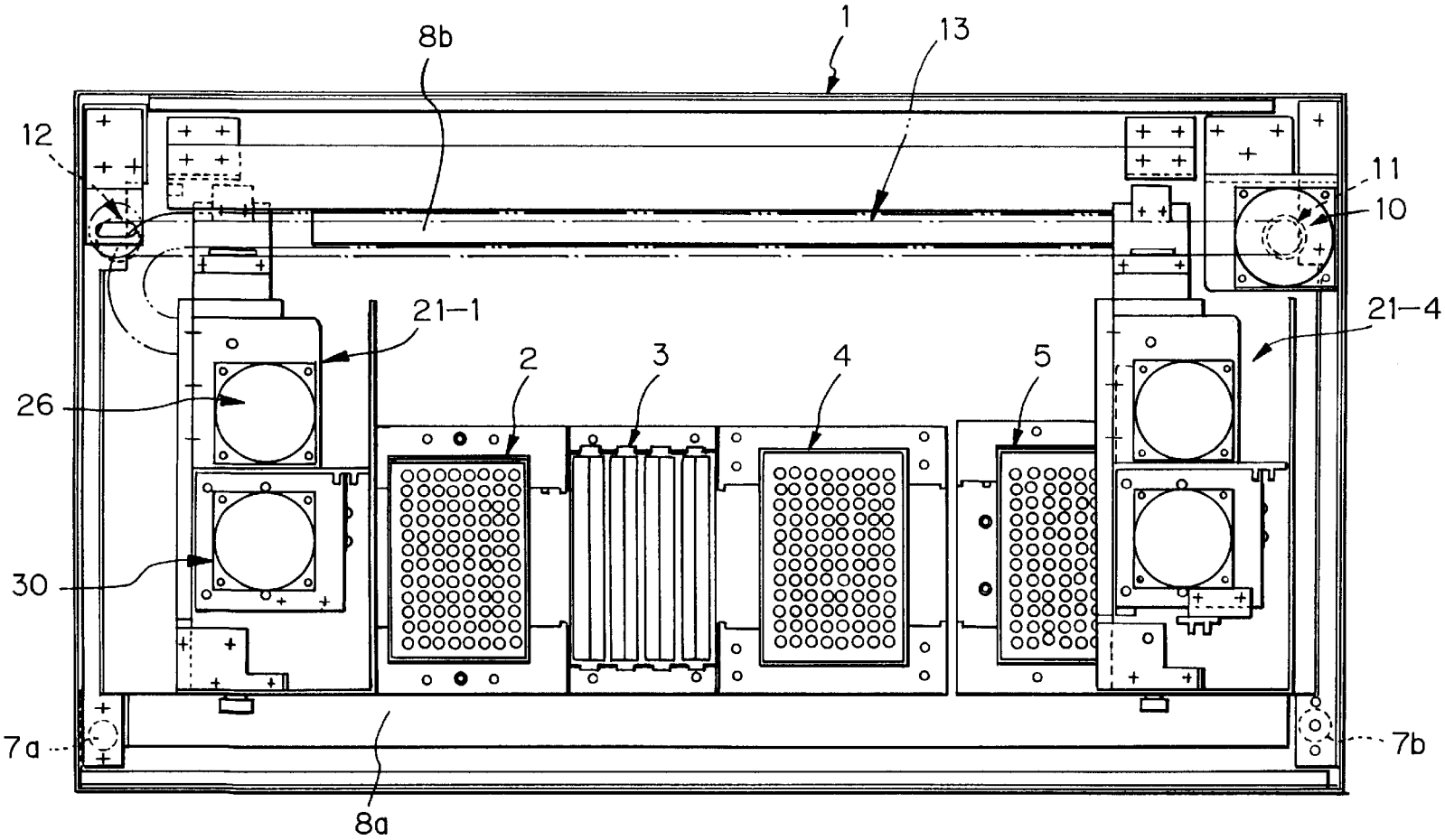
FIG. 1 is a plan view of an apparatus for automatic distribution according to the present invention.
Figure 2:
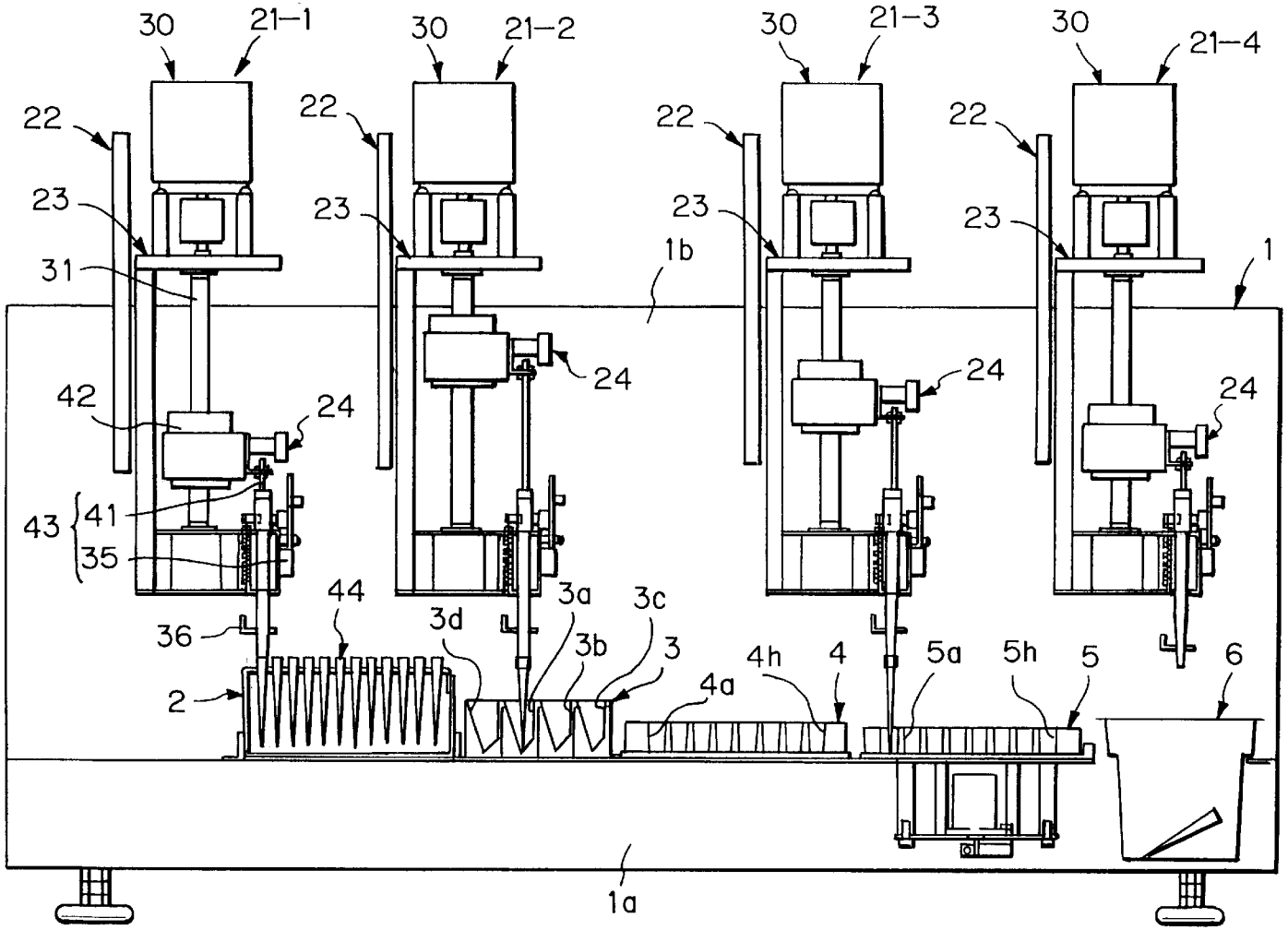
FIG. 2 is a side view of the apparatus.
Figure 3:
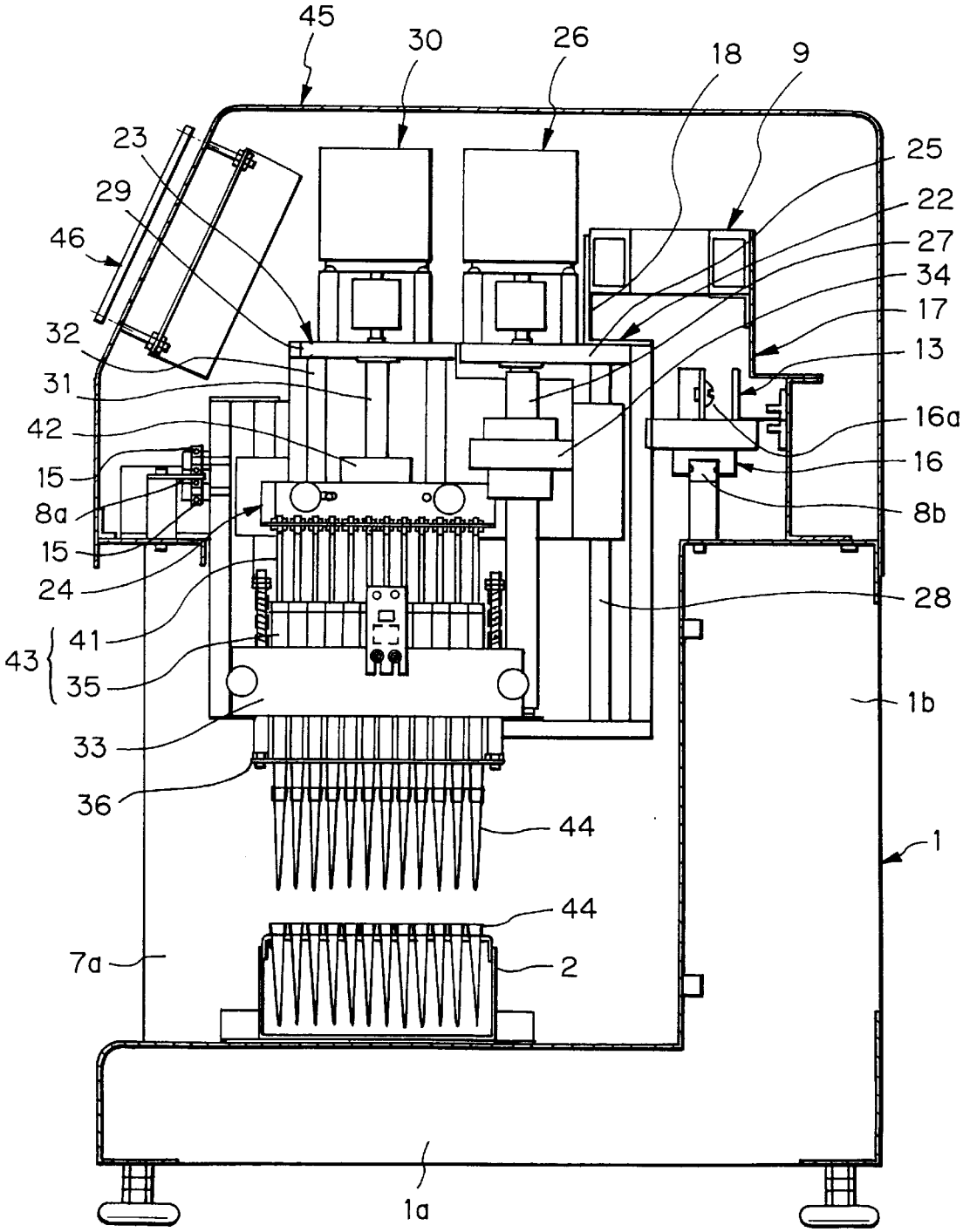
FIG. 3 is a front view of a lift/lower carriage of the apparatus before the carriage is lowered.
Figure 4:
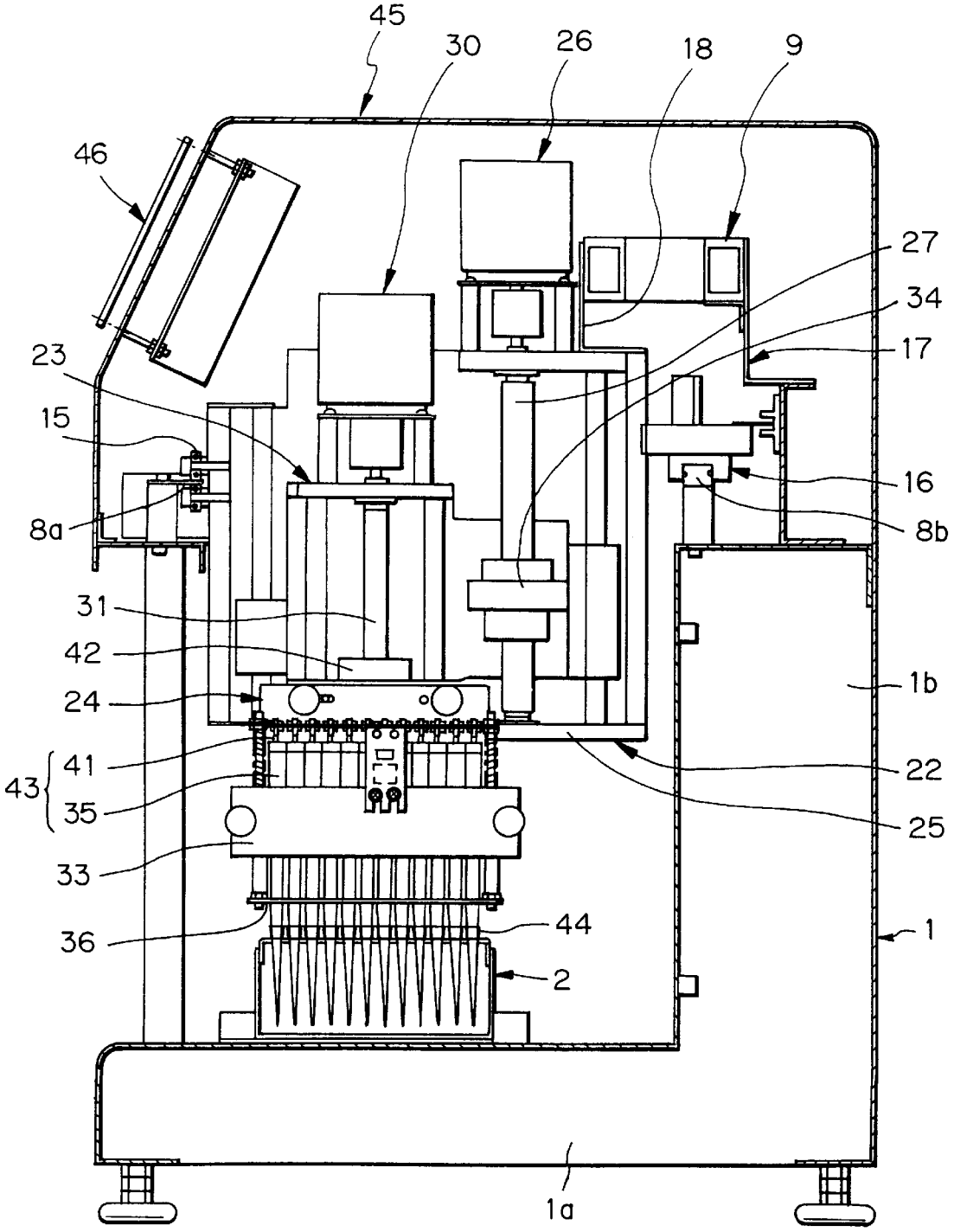
FIG. 4 is a front view of the lift/lower carriage of the apparatus after the carriage is lowered.

In FIGS. 1 to 3, according to an apparatus for automatic distribution of the present invention, for example, a tip holding rack 2, a reservoir 3, micro plates 4 and 5, and a used-tip disposing box 6 are fixedly rested side by side on a bottom frame 1*a* of a frame 1, which has a substantially L-shaped cross-section comprising the bottom frame 1*a* and a side frame 1*b*.

A guide rail 8*a* (also see FIG. 3) extends in a left-and-right direction in FIG. 1 between a pair of posts 7*a* and 7*b* protruding uprightly from both ends of the bottom frame 1*a* at one side (lower side in FIG. 1) thereof, and another guide rail 8*b* (also see FIG. 3) extending in parallel with the guide rail 8*a* is disposed on the side frame 1*b* positioned at the other side (upper side in FIG. 1) of the bottom frame. The guide rail 8*a* is pinched between a pair of rotatable guide rollers 15 of an entire pipette unit 21 which will be described later, and the guide rail 8*b* is engaged by a dovetail guide 16, so that the entire pipette unit 21 is guided by the guide rails 8*a*, 8*b* to move reciprocally in the left-and-right direction in FIG. 1.

A flexible power supply hose 9 having a substantially J-shape (FIG. 1) has one end connected to a frame 17 (FIG. 3) attached to the side frame 1*b* and the other end connected to an L-shaped frame 18 (FIG. 3) of the entire pipette unit 21, and wires (not shown) for supplying power to first and second motors 26 and 30 which will be described later are led through the supply hose 9. The flexible power supply hose 9 can be moved to follow the horizontal reciprocal movement of the entire pipette unit 21.

A motor 10 (disposed at the right side in FIG. 1) for reciprocally driving the entire pipette unit 21 serves to reciprocally rotate an endless timing belt 13 (a portion of which is secured to the dovetail guide 16 by means of a screw 16*a* as shown in FIG. 3) extending between and wound around a pulley 11 which is coaxial with a shaft of the motor 10 and another pulley 12, thereby reciprocating the entire pipette unit 21 in the left-and-right direction in FIG. 1.

The entire pipette unit 21 comprises a horizontal movement carriage 22 (movable in a substantially horizontal direction, i.e., X direction), a-first vertical movement carriage 23 movable in a vertical direction (Z direction) with respect to the carriage 22, and a second vertical movement plunger carriage 24 movable in a vertical direction (Z direction) with respect to the first carriage 23. The plunger carriage 24 can move together with plungers 41 in the vertical direction to suck or discharge liquid into or from tips 44.

The horizontal movement carriage 22 includes a substantially box-shaped carriage body 25, the first motor 26, a first rotatable ball screw 27 (extending in a Z direction) coaxial with the first motor 26 and a guide shaft 28. The vertical movement carriage 23 includes a carriage body 29, the second motor 30, a second rotatable ball screw 31 (extending in a Z direction) coaxial with the second motor 30, a guide shaft 32, a multi-pipette cylinder holding portion 33 and a ball screw nut 34 which is engaged with the first ball screw 27. The cylinder holding portion 33 holds a plurality (twelve, in this case) of cylinders 35 and tip ejectors 36.

The second vertical (Z direction) movement plunger carriage 24 includes a plurality (twelve, in this case) of plungers 41 and a ball screw nut 42 which is engaged with the second ball screw 31. By combination of the plungers 41 and the cylinders 35, twelve sets of multi-pipette (pipettes) 43 are constituted.

Explaining the arrangement on the bottom frame 1*a* again, the tip holding rack 2 holds a plurality of tips 44. In this case, 96 tips (=8 rows (X direction)×12 columns (Y direction)) are held. Further, four tray portions 3*a*–3*d* (a waste tray and first to third trays) are provided in the reservoir 3, and a plurality of wells 4*a*–4*h* and 4*a*14 5*h* are provided on the micro plates 4 and 5, respectively. In this case, 96 wells (=8 rows (X direction)×12 columns (Y direction)) are provided on each micro plate. Incidentally, in FIG. 3, the reference numeral 45 denotes a cover of the apparatus; and 46 denotes a view window formed in the cover 45.

With an arrangement as mentioned above, by driving the motor 10, the entire pipette unit 21 is moved from an initial position, through positions 21-1, 21-2 and 21-3 (FIGS. 1 and 2), to a tip disposing position 21-4 and then is returned to the initial position. During that movement of the unit 21, when the first motor 26 is driven, the first ball screw 27 is rotated. Consequently, the first vertical movement carriage 23 and the second vertical movement plunger carriage 24 are integrally moved vertically as one unit supporting all the pipettes 43 while being guided by the guide shaft 28. As a result, all the pipettes 43 are moved in the vertical direction to effect the mounting or dismounting of the tips 44 and to come close to or go away from the reservoir 3 and the micro plates 4 and 5. When the second motor 30 is driven, the second ball screw 31 is rotated. Consequently, only the second vertical movement plunger carriage 24 is moved vertically while being guided by the guide shaft 32. As a result, the plungers 41 are moved in the vertical direction relative to the cylinders 35, thereby sucking the liquid into the tips 44 or discharging the liquid from the tips 44.

Next, among various operation modes of the apparatus according to the present invention, a first mode or reagent distributing mode shown in FIGS. 5 to 7 will be explained. In this case, as shown in FIG. 5, the reagent is previously stored in the reservoir 3, and the wells on the micro plates 4, 5 are empty.

Figure 5:
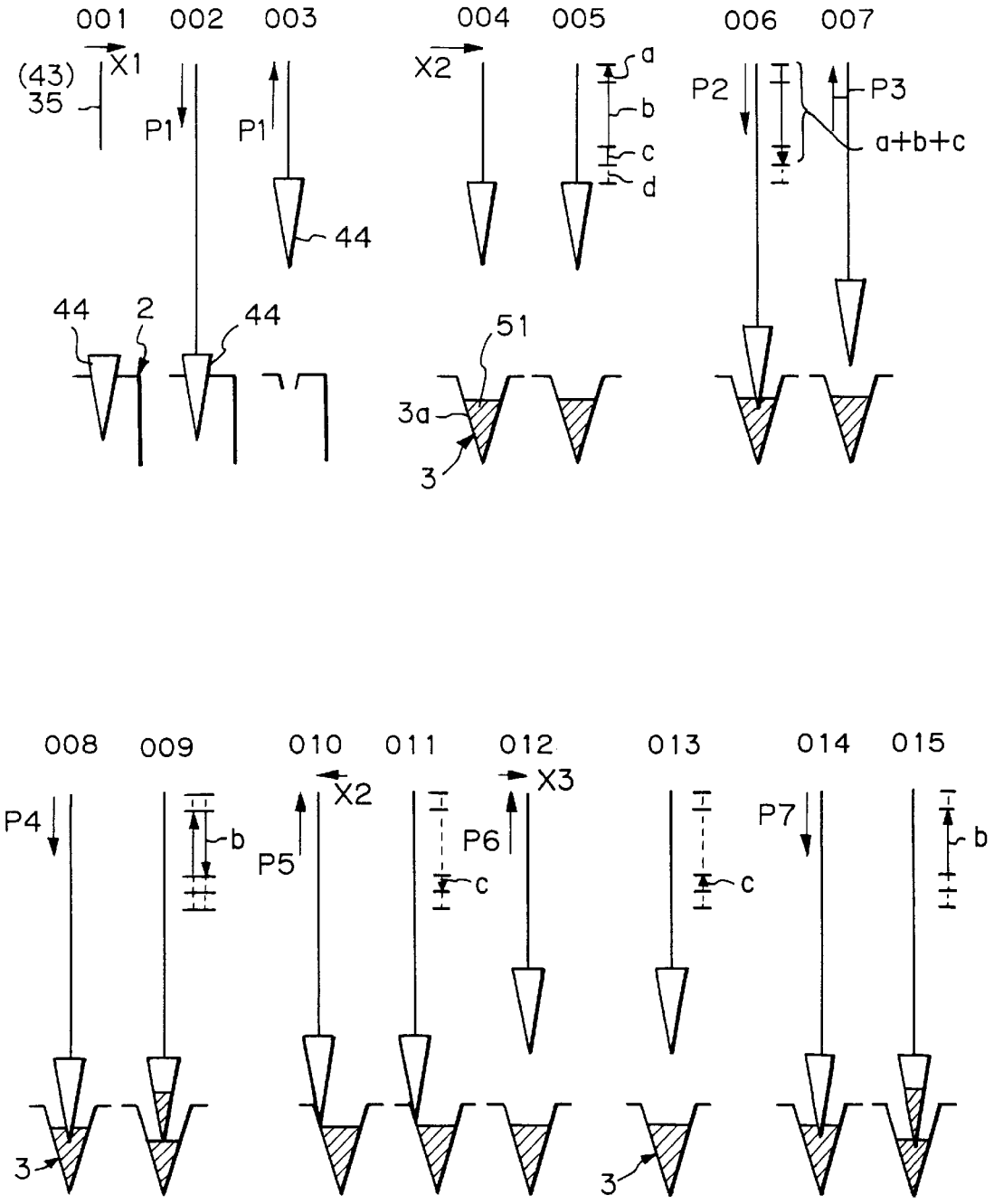
FIGS. 5 to 7 are views showing operation steps of the apparatus in a first mode.
Figure 6:
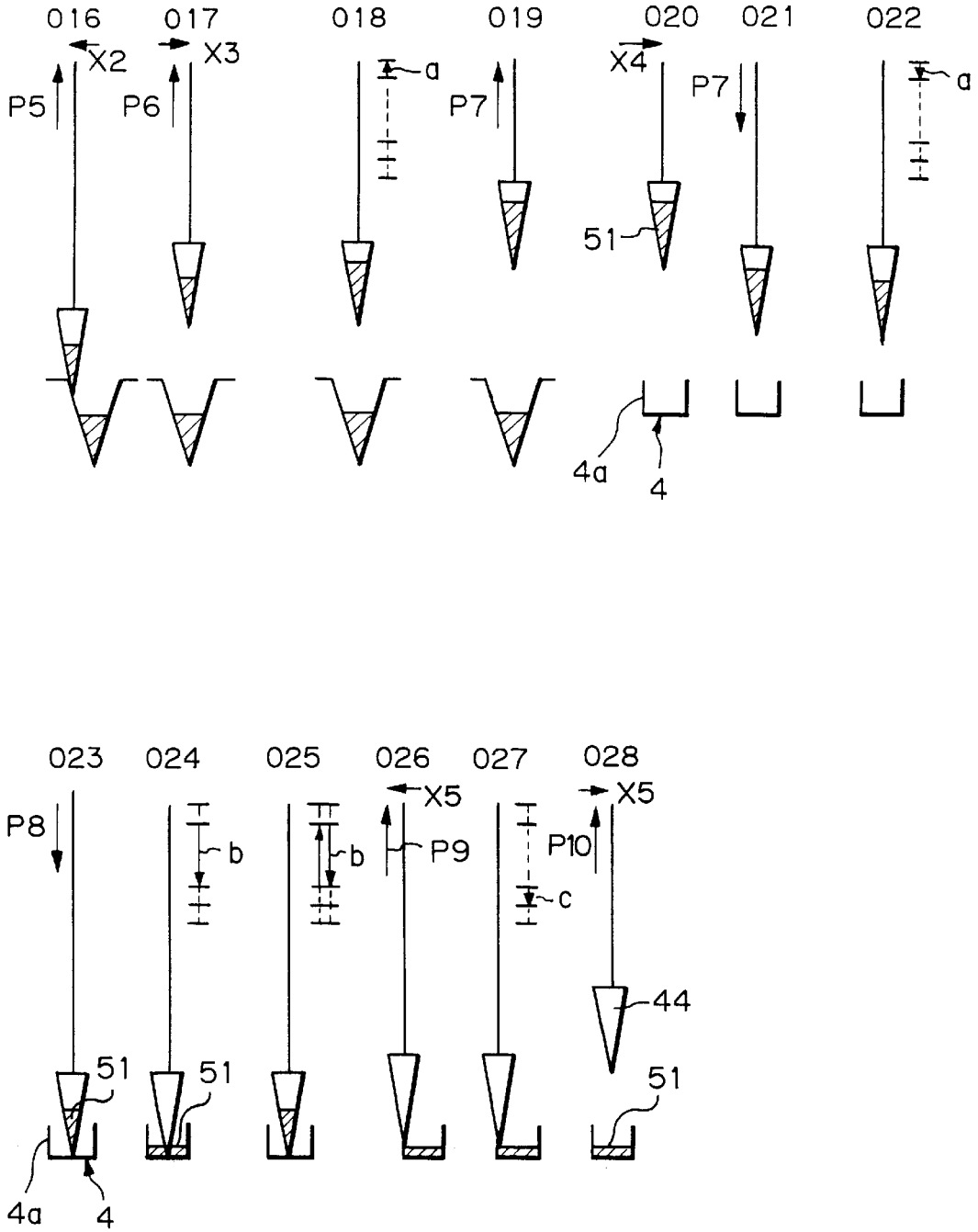
Figure 7:
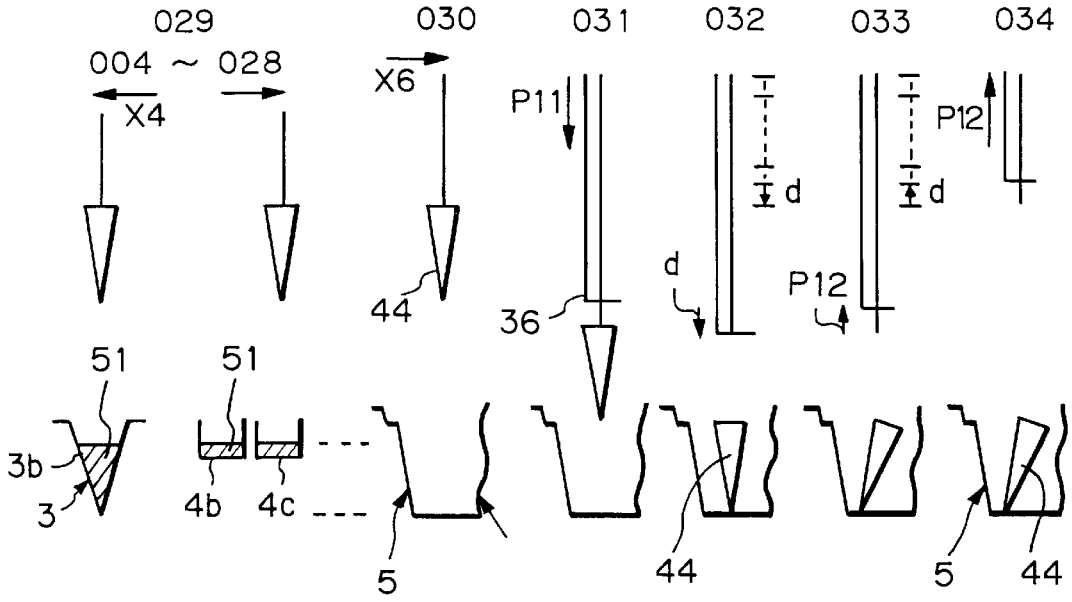

Incidentally, in FIGS. 5 to 7, "X1–X6" denote moving distances of the movement of the entire pipette unit 21; "P1–P12" denote vertical distances of the movement of the whole pipettes 43 (vertical movement of the vertical movement carriage 23 while the horizontal movement carriage 22 is kept stationary); and "a–d" (refer to a step 005 in FIG. 5) denote vertical distances of the movement of only the plungers 41 (i.e., vertical movement plunger carriage 24) of the pipettes 43. More specifically, "a" denotes a post-suction air gap stroke for realizing the situation that the liquid is prevented from dropping from the tips 44 while the tips 44 are being moved to a next position by holding the residual liquid within the tips 44 due to negative air pressure within the tips 44; "b" denotes a metering stroke for sucking or discharging a predetermined amount of liquid into or from each tip; "c" denotes a pre-suction air gap stroke for discharging completely the residual liquid remaining in the tips 44 by air pressure in the tips 44; and "d" denotes an eject stroke of the tip ejector 36 for ejecting the tips 44.

First of all, a first cycle of the first mode will be described.

In a step 001, by driving the motor 10, the entire pipette unit 21 is moved from the initial position to the right by a distance X1, with the result that the cylinders 35 of the pipettes 43 are positioned over and aligned with a first row of tips 44 on the tip holding rack 2. Then, in a step 002, by driving the first motor 26, the first vertical movement carriage 23 (i.e., all of the pipettes 43) is lowered by a distance P1 to press-fit lower ends of the cylinders 35 into upper openings of the tips 44, with the result that the tips 44 are attached to the lower ends of the cylinders 35 (refer to the position 21-1 in FIG. 2). Then, in a step 003, the pipettes 43 are lifted by the distance P1. In this case, it is assumed that the plungers 41 are returned to the initial position (i.e., an upper end of the eject stroke "d" shown in a step 005 which will be described later).

Then, in a step 004, the entire pipette unit 21 is moved in the right direction by a distance X2 to bring the-pipettes 43 to a position corresponding to the first tray 3*a* of the reservoir 3. Then, in a step 005, the plungers 41 are lifted by a distance "a+b+c" (i.e., post-suction air gap stroke "a"+ metering stroke "b"+pre-suction air gap stroke "c"), thereby sucking air (to be used for detection of a position of a liquid surface which will be described later) into the tips 44 and the cylinders 35.

Thereafter, in a step 006, all of the pipettes 43 are lowered by a distance P2; during which, the plungers 41 are lowered relative to the cylinders 35 by the distance "a+b+c" to continuously and steadily discharge the air from the lower ends of the tips 44. Accordingly, when the lower ends of the tips 44 come in contact with the liquid surface of the reagent in the reservoir 3, since the discharging of air is temporarily stopped, air pressure in the cylinder 35 is forced to be temporarily increased. When this pressure increase is detected, the lowering movement of the pipettes 43 are stopped.

Then, in a step 007, all the pipettes 43 are lifted by a distance P3; during which the air continues to be discharged and the plungers 41 are returned to the initial position.

Thereafter, in a step 008, all the pipettes 43 are lowered by a distance P4 (P4>P3), with the result that the lower ends of the tips 44 enter into the reagent 51 by a distance "P4–P3" in order to suck the reagent.

Then, in a step 009, only the plungers 41 are reciprocated in the vertical direction by a distance corresponding to the metering stroke "b" by predetermined times (for example, 1–10 times) to repeat suction and discharge of the reagent, thereby agitating the reagent. Lastly, the plungers 41 are lowered to the lower limit of the metering stroke "b" and then the reagents are discharged. Incidentally, the step 009 may be omitted or may be performed only in the first cycle or may be performed every cycle. An amount of the reagent to be sucked in each time is 1–220 $\mu$l, for example.

Thereafter, in a step 010, all the pipettes 43 are lifted by a small distance P5 and the entire pipette unit 21 is moved in the left direction by a small distance X2, with the result that the tip ends (lower ends) of the tips 44 abut against an inclined inner surface of the reservoir 3 to remove the reagent adhered to the lower ends of the tips. Then, in a step 011, the plungers 41 are lowered by a distance corresponding to the pre-suction air gap stroke "c", thereby completely removing (i.e., blowing off) the reagent adhered to the lower ends of the tips from said lower ends.

Thereafter, in a step 012, all the pipettes 43 are lifted by a distance P6 and the entire pipette unit 21 is moved in the right direction by a small distance X3. Then, in a step 013, the plungers 41 are lifted by the distance corresponding to the pre-suction air gap stroke "c" to be returned to the lower limit position of the metering stroke "b". Incidentally, this pre-suction air gap stroke "c" is reflected as downward pre-suction air gap discharge stroke "c" in a step 027 which will be described later. In this way the agitation of the reagent 51 is finished.

Thereafter, in a step 014, all the pipettes 43 are lowered by a distance P7 to reach a position substantially the same as the position in the step 008. Then, in a step 015, the plungers 41 are lifted by a distance corresponding to the metering stroke "b", thereby sucking the predetermined amount of reagent 51 into each of the tips 44 and the cylinders 35 (refer to the position 21-2 in FIG. 2).

Thereafter, in a step 016, like the step 010, all the pipettes 43 are lifted by the small distance P5 and the entire pipettes unit 21 is moved in the left direction by the small distance X2, with the result that the tip ends of the tips 44 abut against the inclined inner surface of the reservoir 3 to remove the reagent adhered to the lower ends of the tips. Then, in a step 017, like the step 012, all the pipettes 43 are lifted by the distance P6 and the entire pipette unit 21 is moved in the right direction by the small distance X3.

Then, in a step 018, the plungers 41 are lifted by a distance corresponding to the post-suction air gap stroke "a", thereby sucking the liquid adhered to the outer surfaces of the lower ends of the tips into the tips so that such liquid is prevented from dropping from the tips during a horizontal movement in a step 020 which will be described later. Thereafter, in a step 019, the entire pipette unit 21 is lifted by a small distance P7 so that the lower ends of the tips 44 do not interfere with parts of the apparatus during the horizontal movement in the next step 020.

Then, in the step 020, the entire pipette unit 21 is moved in the right direction by a distance X4 so that the pipettes are positioned over and aligned with a first row of wells 4*a* (all empty) on the micro plate 4. Then, in a step 021, all the pipettes 43 are lowered by the distance P7, and, in a step 022, only the plungers 41 are lowered by the distance corresponding to the post-suction air gap stroke "a" (lifted in the step 018) to discharge the air, thereby preventing bubbles from generating due to air discharge when the reagent is discharged in next steps 023 and 024.

Thereafter, in the step 023, all the pipettes 43 are lowered by a distance P8 to position the lower ends of the tips in the vicinity of the bottoms of the wells 4*a*. Then, in the step 024, only the plungers 41 are lowered by the distance corresponding to the metering stroke "b", thereby discharging the reagent 51 into the wells 4*a* (refer to the position 21-3 in FIG. 2).

Then, in a step 025, only the plungers 41 are reciprocated in the vertical direction by the distance corresponding to the metering stroke "b" by predetermined times (for example, 1–10 times) to repeat suction and discharge of the reagent, thereby agitating the reagent. Lastly, the plungers 41 are lowered to the lower limit of the metering stroke "b" and then the reagents are discharged. Incidentally, this step 025 may be omitted or may be performed only in the first cycle or may be performed every cycle. An amount of sucked reagent in each time is 1–220 $\mu$l, for example. In the above case, while an example that all the wells 4*a* are empty in an initial condition was employed, the present invention is not limited to such an example, but, reagents different from the reagent 51 in the reservoir 3 may be previously distributed in the wells 4*a*. In that case, the reagent in each well 4*a* is agitated and mixed with the other reagent from the reservoir 3. This may be adopted regarding other wells.

Thereafter, in a step 026, all the pipettes 43 are lifted by a small distance P9 and the entire pipette unit 21 is moved in the left direction by a small distance X5, with the result that the tip ends of the tips 44 abut against inclined inner surfaces of the wells 4*a* to remove the reagent adhered to the lower ends of the tips. Then, in a step 027, the plungers 41 are lowered by a distance corresponding to the pre-suction air gap stroke "c" (corresponding to the pre-suction air gap stroke "c" in the step 013), thereby completely removing (or blowing off) the reagent adhered to the lower ends of the tips from said lower ends.

Then, in a step 028, all the pipettes 43 are lifted by a distance P10 and the entire pipette unit 21 is moved in the right direction by a small distance X5. Then, in a step 029, the entire pipette unit 21 is moved horizontally in the left direction by the distance X4 to reach the position shown in the step 004. In this way, the first cycle is completed.

Next, as a second cycle, the steps 004 to 029 in the first cycle are repeated. In this case, however, the reagent from the reservoir 3 is distributed into a second row of wells 4*b*. In this way, third to eighth cycles are similarly repeated, so that, by appropriately using first to third trays 3*a*–3*c* of the reservoir 3, the reagent is distributed into all of the wells 4*a*–4*h* on the micro plate 4.

Thereafter, the reagent is similarly distributed into all the wells 5*a*–5*h* on the micro plate 5.

As a last step of the first mode, in a step 030, the entire pipette unit 21 is moved in the right direction by a distance X6 to align the pipettes 43 with the used-tip disposing box 6. Then, in a step 031, the entire pipette unit 21 is lowered by a distance P11 to carry the tips 44 close to the used-tip disposing box 6. Then, in a step 032, the ejector 36 is lowered together with the plungers 41 by a distance corresponding to the eject stroke "d", thereby ejecting and disposing of the tips 44 into the used-tip disposing box 6 (refer to the position 21-4 in FIGS. 1 and 2). The used-tips 44 are discarded, or cleaned for re-use.

Thereafter, in a step 033, the ejector 36 is lifted together with the plungers 41 by the distance corresponding to the eject stroke "d", and, in a next step 034, the entire pipette unit 21 is lifted by a distance P12 and then is moved in the left direction to return to the initial position. In this way, the first liquid distributing mode is completed. Of course, the first mode may be repeated by times corresponding to the number of rows of tips 44 on the tip holding rack 2.

As another example (for example, as a second mode), there is a monitor mode for monitoring HCV (Hepatitis C Virus).

In this case, in place of the reservoir 3, a PCR {Polymerase Chain Reaction which is DNA chain reaction due to Polymerase (one of enzymes)} tube containing test liquid such as whole blood or blood serum is arranged at a position where the reservoir was positioned. After the test liquid in the PCR tube is sucked into the entire pipette unit 21, the entire pipette unit 21 is moved to the position corresponding to the first row of wells 4*a* (on the micro plate 4) within which the reagent was actually distributed in the first mode.

Then, the test liquid was distributed into the wells (containing the reagent) to dilute the test liquid. Then, the diluted test liquid is sucked. Thereafter, the entire pipette unit is moved to a position corresponding to a second row of wells 4*b* to distribute the diluted test liquid into the reagent in the wells 4*b*, thereby further diluting the test liquid. Then, the further diluted test liquid is sucked and then is further diluted similarly by three times (namely, the test liquid is diluted by five times regarding the wells 4*a*–4*e*). Then, the tips 44 are discarded. Thereafter, by using new tips 44, the test liquid is further diluted by three times regarding the three rows of wells 4*f*–4*h*. Then, the tips 44 are discarded. The reason why the diluting operations are divided into five rows and three rows is that the test liquid is firstly diluted gradually by using the five rows, meanwhile reaction between the enzyme and the test liquid occurred during the dilution is observed, and reaction between the enzyme and the test liquid occurred during the dilution regarding the remaining three rows is also observed, and the observed results can be compared.

As a further example (for example, as a third mode), there is a monitor mode for monitoring HIV (Human Immunodeficiency Virus). Also in this case, the PCR tube containing test liquid such as whole blood or blood serum is used in place of the reservoir 3, and, this third mode is effected in a manner substantially similar to the second mode. However, by using the first tips 44, the diluting operations are effected by six times regarding the six rows of wells 4*a*–4*f* and, by using the next tips 44, two diluting operations are effected regarding the remaining two rows of wells 4*g* and 4*h*. The reason why the diluting operations are divided into six rows and two rows is the same as the second mode.

As a still further example (for example, as a fourth mode), there is a qualitative mode. According to the qualitative mode, the test liquid from the wells 4*a* on the micro plate 4 is distributed into the reagent in the wells 5*a* on the other micro plate 5 and the tips 44 are discarded. The same operations are repeated regarding the wells 4*b*/5*b*–4*h*/5*h* (8 in total).

The present invention is not limited to the above-mentioned embodiment, and various alterations and modifications can be effected within the scope of the invention.

What is claimed is:

1. A method for automatic distribution performed by using an apparatus for automatic distribution including a frame having at least a bottom frame section and a side frame section, a tip holding rack, a reservoir, at least one first micro plate, and a used-tip disposing box which are disposed on said bottom frame section, and an entire pipette unit supported by said side frame section and adapted to support a plurality of pipettes which each include a plunger fitted into a cylinder for movement relative thereto in a vertical direction, the method comprising:

a first step of attaching tips to lower ends of said plurality of pipettes by moving said plurality of pipettes in downward and upward directions;

a second step of bringing said entire pipette unit to a position corresponding to said reservoir by moving said entire pipette unit in the horizontal direction by a first predetermined distance and then sucking predetermined liquid into said tips by moving said plurality of pipettes in the downward and upward directions;

a third step of bringing said entire pipette unit to a position corresponding to a first row of wells of said micro plate by further moving said entire pipette unit in the horizontal direction by a second predetermined distance and then distributing the liquid with respect to said first row of wells by moving said plurality of pipettes in the downward and upward directions;

a fourth step of distributing the liquid with respect to the other rows of wells of said micro plate by further moving said entire pipette unit successively in the horizontal direction by a third predetermined distance; and a fifth step of bringing said entire pipette unit to a position corresponding to said used-tip disposing box by further moving said entire pipette unit in the horizontal direction by a fourth predetermined distance and disposing of said tips into said used-tip disposing box and then returning said entire pipette unit to an initial position, wherein, in said second to fourth steps, a stroke through which each plunger is moved with respect to said cylinder in the vertical direction to suck and discharge the liquid including a post-suction air gap stroke through which said plunger is further moved in the upward direction by a predetermined distance to prevent the liquid from dropping from said tip after the liquid is sucked into said tip, metering stroke for sucking a predetermined amount of liquid into said tip and for discharging the liquid from said tip, and pre-suction air gas stroke through which said plunger is further moved in the upward direction by a predetermined distance to completely remove the liquid from said tip during the liquid discharging in the post-process before the liquid is sucked into said tip.

2. A method for automatic distribution according to claim 1, wherein a PCR tube containing test liquid is used in place of said reservoir.

3. A method for automatic distribution according to claim 1, wherein a second micro plate is used in place of said reservoir and test liquid in said second micro plate is distributed into said first micro plate.

4. A method for automatic distribution performing by using an apparatus for automatic distribution including a frame having at least a bottom frame section and a side frame section, a tip holding rack, a reservoir, at least one first micro plate, and a used-tip disposing box which are disposed on said bottom frame section, and an entire pipette unit supported by said side frame section and adapted to support a plurality of pipettes each of which includes a plunger fitted into a cylinder for movement relative thereto in a vertical direction, the method comprising:

a first step of attaching tips to lower ends of said plurality of pipettes by moving said plurality of pipettes in downward and upward directions;

a second step of bringing said entire pipette unit to a position corresponding to said reservoir by moving said entire pipette unit in the horizontal direction by a first predetermined distance and then sucking predetermined liquid into said tips by moving said plurality of pipettes in the downward and upward directions;

a third step of bringing said entire pipette unit to a position corresponding to a first row of wells of said micro plate by further moving said entire pipette unit in the horizontal direction by a second predetermined distance and then distributing the liquid with respect to said first row of wells by moving said plurality of pipettes in the downward and upward directions;

a fourth step of distributing the liquid with respect to the other rows of wells of said micro plate by further moving said entire pipette unit successively in the horizontal direction by a third predetermined distance; and a fifth step of bringing said entire pipette unit to a position corresponding to said used-tip disposing box by further moving said entire pipette unit in the horizontal direction by a fourth predetermined distance and disposing of said tips into said used-tip disposing box and then returning said entire pipette unit to an initial position, wherein, in said second step, while the plurality of pipettes are being moved in the downward direction, said plungers being lowered within the corresponding cylinders to continue to discharge air from the tip ends of said tips steadily so that the fact that said tip ends of said tips come in contact with the liquid surface can be detected, thereby automatically detecting the position of the liquid surface.

5. A method for automatic distribution according to 4, wherein a PCR tube containing test liquid is used in place of said reservoir.

6. A method for automatic distribution according to claim 4, wherein a second micro plate is used in place of said reservoir, and test liquid in said second micro plate is distributed into said first micro plate.

* * * * *